US007794360B2

(12) United States Patent
Publicover

(10) Patent No.: US 7,794,360 B2
(45) Date of Patent: Sep. 14, 2010

(54) TRAMPOLINE AND THE LIKE WITH ENCLOSURE

(76) Inventor: Mark W. Publicover, 18505 Marshall La., Saratoga, CA (US) 95070

( * ) Notice: Subject to any disclaimer, the term of this patent is extended or adjusted under 35 U.S.C. 154(b) by 0 days.

(21) Appl. No.: 12/111,160

(22) Filed: Apr. 28, 2008

(65) Prior Publication Data

US 2008/0269021 A1 Oct. 30, 2008

Related U.S. Application Data

(60) Provisional application No. 60/914,312, filed on Apr. 26, 2007.

(51) Int. Cl.
*A63B 21/00* (2006.01)

(52) U.S. Cl. ..... 482/27; 482/28

(58) Field of Classification Search ..... 482/27, 482/28; 256/23–32, 49, 65.07, 65.06, 70
See application file for complete search history.

(56) References Cited

U.S. PATENT DOCUMENTS

| | | | | |
|---|---|---|---|---|
| 6,053,845 | A | 4/2000 | Publicover et al. | |
| 6,261,207 | B1 * | 7/2001 | Publicover et al. | 482/27 |
| 2002/0137598 | A1 | 9/2002 | Publicover et al. | |
| 2004/0121883 | A1 | 6/2004 | Publicover | |

* cited by examiner

*Primary Examiner*—Jerome Donnelly
(74) *Attorney, Agent, or Firm*—Klarquist Sparkman, LLP

(57) ABSTRACT

A fence surrounds a trampoline and extends above the rebounding surface, reducing the risk of injury. Shock absorption is aided by a support system of independent poles, linked at their tops by a flexible strap or line which is attached directly to a protective cap at the top of each pole. Also disclosed are a method and apparatus for attaching a pad to a trampoline frame either with or without an enclosure.

3 Claims, 5 Drawing Sheets

TRAMPOLINE AND THE LIKE WITH ENCLOSURE

CROSS-REFERENCE TO RELATED APPLICATION

This application claims the benefit of U.S. Provisional Application No. 60/914,312, filed Apr. 26, 2007.

BACKGROUND AND SUMMARY

The present invention concerns wall structures used with trampolines to protect trampoline users and to provide new uses for trampolines.

In the past, trampolines have been used for a variety of athletic and recreational purposes. However, injuries have sometimes resulted when a person jumping on a trampoline would land too near the boundary of the rebounding surface and strike the trampoline frame or fall from the trampoline to the ground. An article in the Mar. 3, 1998, *New York Times* reports that trampoline-related emergency room hospitalizations of children doubled between 1990 and 1995 (to nearly 60,000), and that the rate of injuries shows no sign of abating. Some in the medical community have called for a ban on the sale of home trampolines. While stopping short of a ban, the U.S. Consumer Products Safety Commission has called for safety improvements to home trampolines.

One approach to reducing such injuries has been to form a wall around the perimeter of a trampoline bed so that when a jumper lands too near the edge, the wall prevents the jumper from falling off. For example, U.S. Pat. Nos. 6,261,207 and 6,053,845 illustrate a perimeter wall that forms a resilient enclosure.

While using a trampoline, there is also danger that the person may fall onto the frame or into the area between the bouncing surface and the trampoline frame. Consumer protection safety laws require trampolines to have some type of pad on the trampoline frame. Trampoline safety pads cover the trampoline frame and trampoline springs so as to satisfy these regulations and provide a safer trampoline.

Ties, cords or straps are used to attach the safety pads to the trampoline frame. A common method of attaching the pad to the frame is the use of narrow straps or cords. These straps are wrapped around the frame, pass through an opening in the pad and are then tied off or secured on the outside surface of the pad.

The means currently employed to secure safety pads to the trampoline frame have shortcomings. First, current ties have a very small amount of surface contact with the frame. Consequently, the ties are able to slip and shift quite easily along the frame. This is undesirable because the pad may interfere with the bouncing surface. Second, ties are secured to the trampoline frame itself, which does not keep them in the proper position relative to the trampoline rebounding surface, which can shift inward and expose a gap between the edge of the rebounding surface and the edge of the trampoline.

Improved trampoline safety enclosure systems and construction methods are described herein.

As described herein, a trampoline safety enclosure system has a novel protective cap. The configuration of the protective cap enables a flexible strap or line at the upper edge of the netting material to be attached directly to it so that the top surface of the protective cap is nearly even with the upper edge of the netting material. In this way, protrusion of the protective cap and potential for injury to the jumper are minimized.

A trampoline pad and a method and apparatus for attaching the trampoline pad to a trampoline frame are described, wherein a cord is attached to the pad by means of an assembly having an upper disk with a hole or plurality of holes on top of the pad and a lower disk with a hole or plurality of holes below the pad. The cord is looped through the upper disk, the pad, the lower disk, and is then attached to the ring of the bouncing surface by means of a rigid connector which forms a "T" at the end of the cord. This arrangement may be utilized for a trampoline either with or without a trampoline safety enclosure system.

Also described are a trampoline pad and a method and apparatus for attaching the trampoline pad to a trampoline frame, wherein a cord is attached to the pad by means of a two-piece assembly having an upper part on top of the pad, a lower part below the pad, and a fastener connecting the two by means of a hole or other opening in the pad. The cord is looped through the lower part and then attached to the ring of the bouncing surface by means of a rigid connector which forms a "T" at the end of the cord. This arrangement also may be utilized for a trampoline either with or without a trampoline safety enclosure system.

A trampoline pad and a method and apparatus for attaching the trampoline pad to a trampoline frame using a cord with a rigid connector which forms a "T" at one end also is described. A cord is attached to the pad by means of a two holes or an attachment point. The cord is looped around the frame of the trampoline and attached to a rigid connector. This arrangement may be utilized for a trampoline either with or without a trampoline safety enclosure system.

DETAILED DESCRIPTION

A general description of a suitable trampoline is provided below in order to establish a context in which to understand the present invention. However, it should be noted that the applications in which the present invention may be used are not limited to the trampoline described below.

Figure 1:
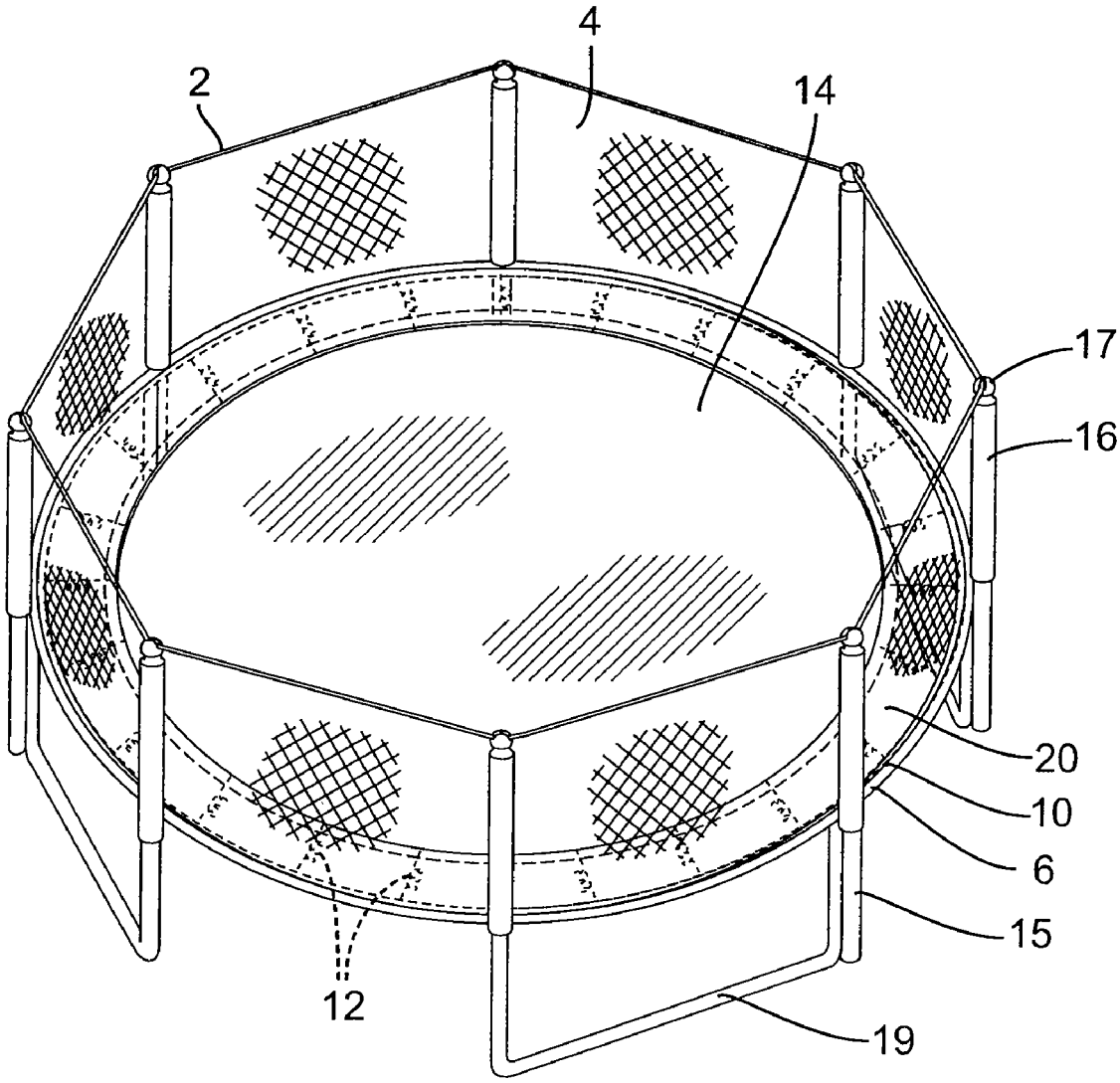
FIG. 1 is an oblique view showing a trampoline apparatus including an enclosure system.

Generally, a trampoline, as shown in FIG. 1, consists of a frame 10, a bouncing surface 14 and springs 12. The frame 10 provides support for the bouncing surface 14, and is linked to the bouncing surface 14 via the trampoline springs 12. The frame 10, springs 12 and bouncing surface 14 are conventional.

The trampoline frame 10 is supported by U-shaped legs 19. In a preferred embodiment, these frame members are cylindrical steel tubes. In FIG. 1, the horizontal frame members 6 are attached to form a circle-shaped trampoline frame 10. However, the trampoline frame members could be joined to form a variety of shapes including a hexagon, rectangle, octagon and an ellipse.

In FIG. 1, the bouncing surface 14, like the frame 10, is circular in shape. Also, like the frame 10, the bouncing surface 14 can have a variety of shapes such as hexagonal, elliptical, rectangular or octagonal. The bouncing surface 14 provides an elasticized area for individuals to perform activities such as acrobatics, flips and various exercises. It is attached to and held by the trampoline frame 10 using trampoline springs 12. It is preferred to use trampoline springs 12; however, the bouncing surface 14 may be secured by any means capable of attaching the bouncing surface 14 to the frame 10 and creating a biased, resilient connection between the bouncing surface 14 and the frame 10. The trampoline springs 12 are attached at one end to the bouncing surface 14 and are attached at the other end to the frame 10.

The bouncing surface 14 is disposed within the circumference of the frame 10 and the frame 10 is situated radially outward of the bouncing surface 14. With this frame of reference, in the following description horizontal movement towards the bouncing surface 14 is referred to as "radially inward" and horizontal movement away from the bouncing surface 14 is referred to as "radially outward."

The basic elements of the trampoline enclosure system work to prevent the user from bouncing beyond the edges of the trampoline surface. The system includes fence poles 15 which attach to the U-shaped legs 19 of the trampoline. Above the surface of the trampoline bed these poles are covered by padding 6. The fence poles support netting material 4, which extends from the surface of the trampoline bed 14 to protective caps 17. The upper edge of netting material 4 is further reinforced by a flexible line 2 which runs along its upper edge. Flexible line 2 is also connected to the protective caps 17.

Figure 2:
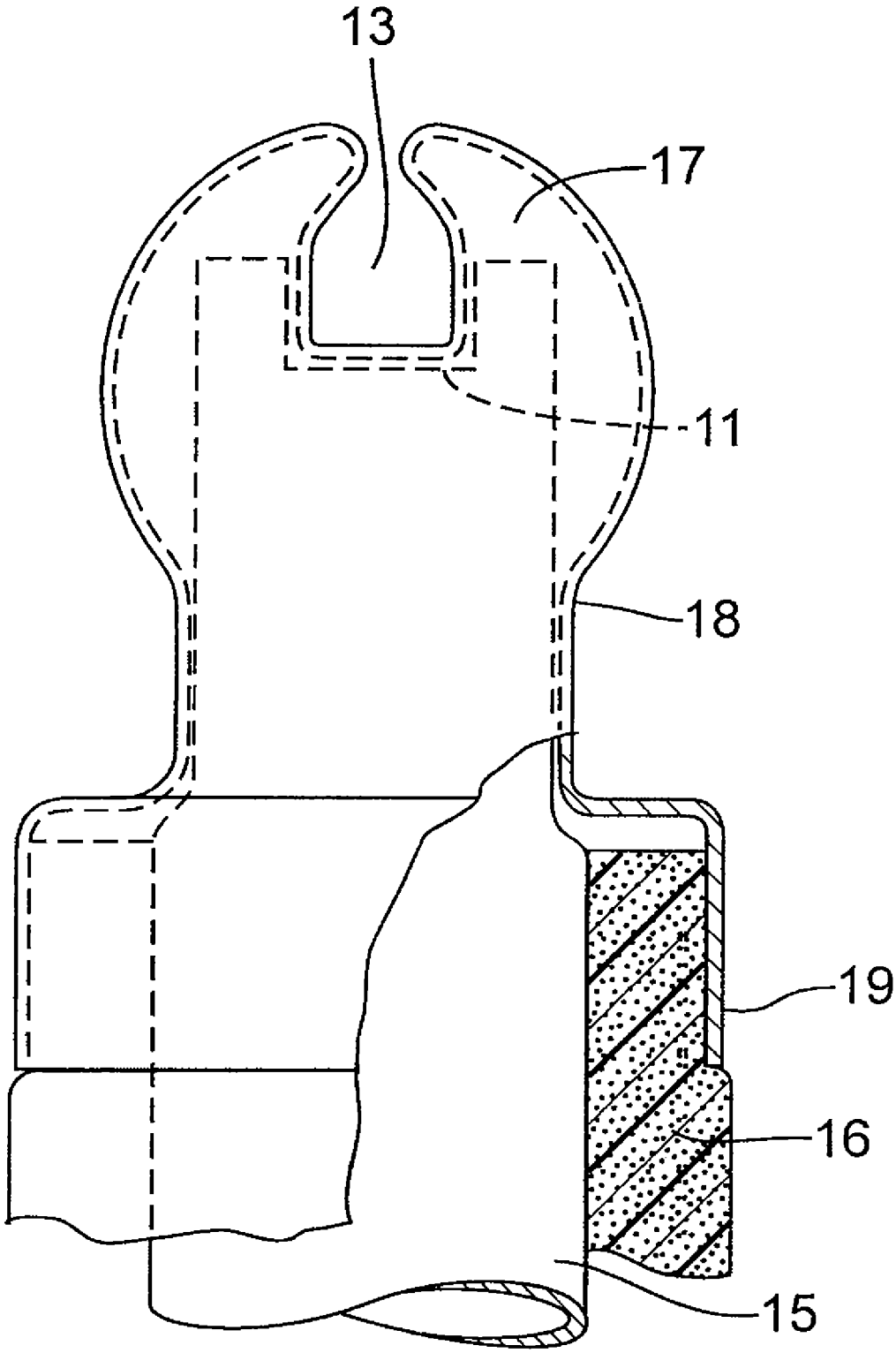
FIG. 2 is an enlarged vertical cross-sectional view of the protective cap at the top of the pole.

One arrangement of an enclosure protective cap is shown in FIG. 2. Protective cap 17 fits on the top of fence pole 15. The protective cap defines an upwardly opening slot 13 proportioned such that its lower edge may be aligned with and fit into cutouts 11 at the top of fence pole 15. With this arrangement, a solid connection made between the fence pole 15 and protective cap 17 which does not allow the cap to rotate. The protective cap is further reinforced by the edge of the fence pole so that it can better withstand forces applied by the flexible line 2. The protective cap slot is narrowed at its upper region and widens at its base, such that the flexible line may be passed into the slot, and then tends to remain within the lower region of the slot during normal use. The top surface of the protective cap is nearly even with the upper edge of the netting material reducing potential for injury to the user. The upper region of the protective cap is domed to create a large surface area. This also helps to prevent injury to the user in case of impact with the protective cap. The mid section 18 of the cap is narrowed so that its inner diameter conforms to the outer diameter of fence pole 15 to provide a snug fit. The lower section 19 of the protective cap widens such that its inner diameter conforms to the outer diameter of padding 16 to provide a snug fit.

The protective caps 17 on the ends of the fence poles can have various forms. For example, a domed cap can be used as shown in FIG. 2, manufactured of a somewhat soft material to dampen impacts, while still providing protection from the top end of the support pole. The cap can be filled with foam or caulk for increased shock absorbency. The cap can also be provided with an accordion-type wall configuration, to enhance its shock absorbing ability. The size of the cap can be increased, to enlarge the surface area that an impacting body hits, and the cap can be bent (typically outwardly) to provide more ready deformability. Combinations of the above-described protective cap features also may be used.

As shown in FIG. 1, one or more trampoline safety pads 20 are attached to a trampoline frame 10. The pad 20 is placed on the frame so as to cover the springs 12 and frame 10 and provide protection to the user from impact. Each trampoline safety pad 20 partially or completely covers trampoline springs 12, which hold a bouncing surface 14 to the trampoline frame 10. The safety pad 20 may be comprised of closed cell polyethylene foam and/or comprised of materials such as cross-linked polyethylene, open celled polyurethane and rim molded polyurethane. Best results are achieved when the foam used to construct the pad 20 is high density foam.

Figure 3:
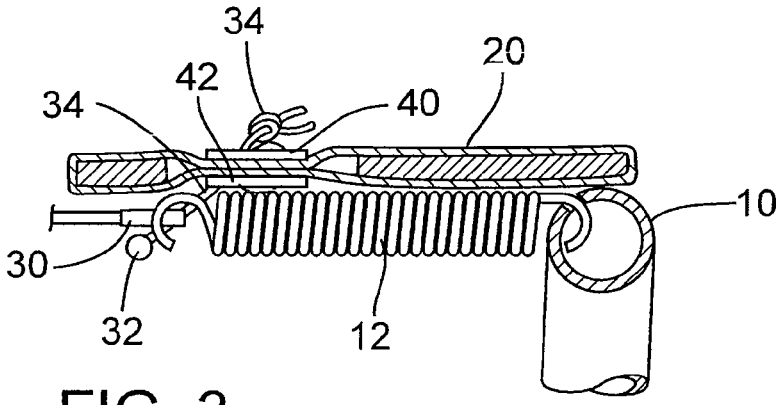
FIG. 3 is a cross sectional view of a first apparatus for attaching a pad to a trampoline frame.
Figure 4:
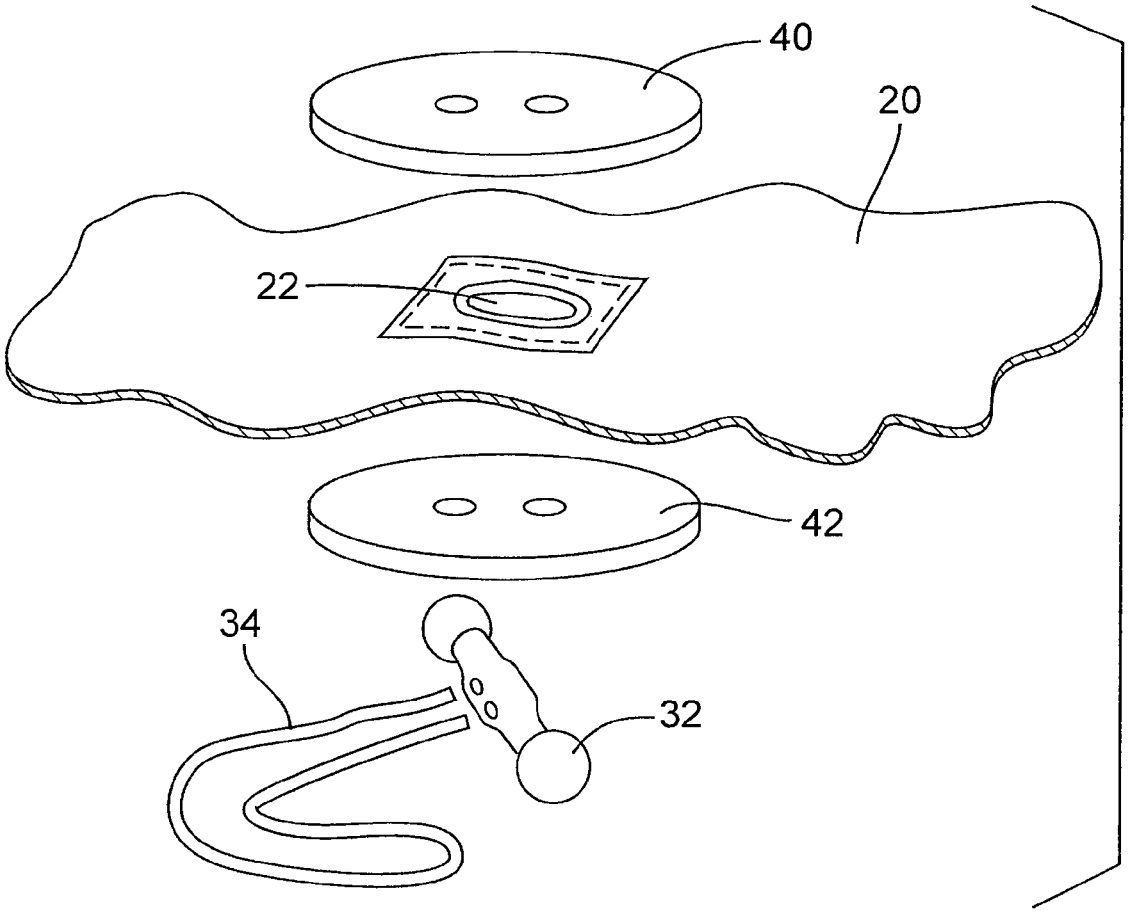
FIG. 4 is an exploded oblique view showing the individual components used in the attachment apparatus of FIG. 3.
Figure 5:
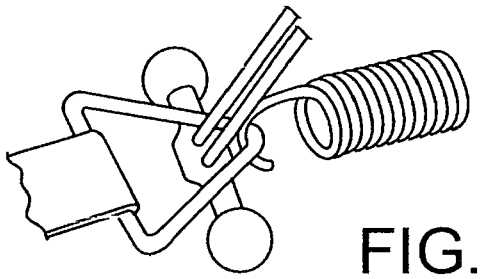
FIG. 5 is an oblique view of the apparatus of FIG. 3, showing the attachment of a cord to a bed ring.

In the arrangement seen in FIG. 3, an upper disk 40 is attached on the upper surface of the safety pad 20 and a lower disk 42 is attached to the lower surface of the safety pad 20 and connected by means of a cord 34 passing through a trampoline safety pad hole 22 and tied in a knot on both sides. In the illustrated arrangement, safety pad hole 22 consists of a larger opening of material cut out from the foam pad as well as a smaller opening of material cut out from both the upper and lower cover of the pad. The opening of the hole is reinforced with a sewn grommet of PVC or other similar elastomeric material which binds the upper and lower cover of the pad together. Another arrangement of the safety pad hole is an opening which is reinforced with a sheet metal grommet. The other end of the cord 34 is connected to a rigid connector piece 32. FIG. 4 shows the relationship between the components mentioned in this arrangement. The rigid connector piece 32 is then attached to a bouncing surface ring 30 as shown in FIG. 5.

The following explains a method of attaching the trampoline safety pad 20 to a trampoline frame 10. The trampoline safety pad 20 is positioned so that trampoline pad holes 22 match with bouncing surface rings 30. For each trampoline pad hole 22, either the upper disk 40 and lower disk 42 or upper assembly part 50 and lower assembly part 52 should be attached to the safety pad 20 and connected to the rigid connector piece 32 with the cord 34. The rigid connector piece 32 is then attached to the bouncing surface ring 30. The foregoing steps should be repeated until all holes 22 in the trampoline safety pads 20 have been used.

Figure 6:
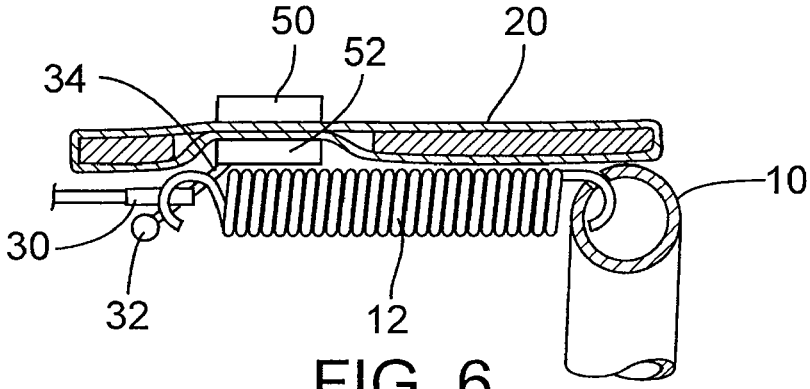
FIG. 6 is an enlarged vertical cross-sectional view of a second apparatus for attaching a pad to a trampoline frame.
Figure 7:
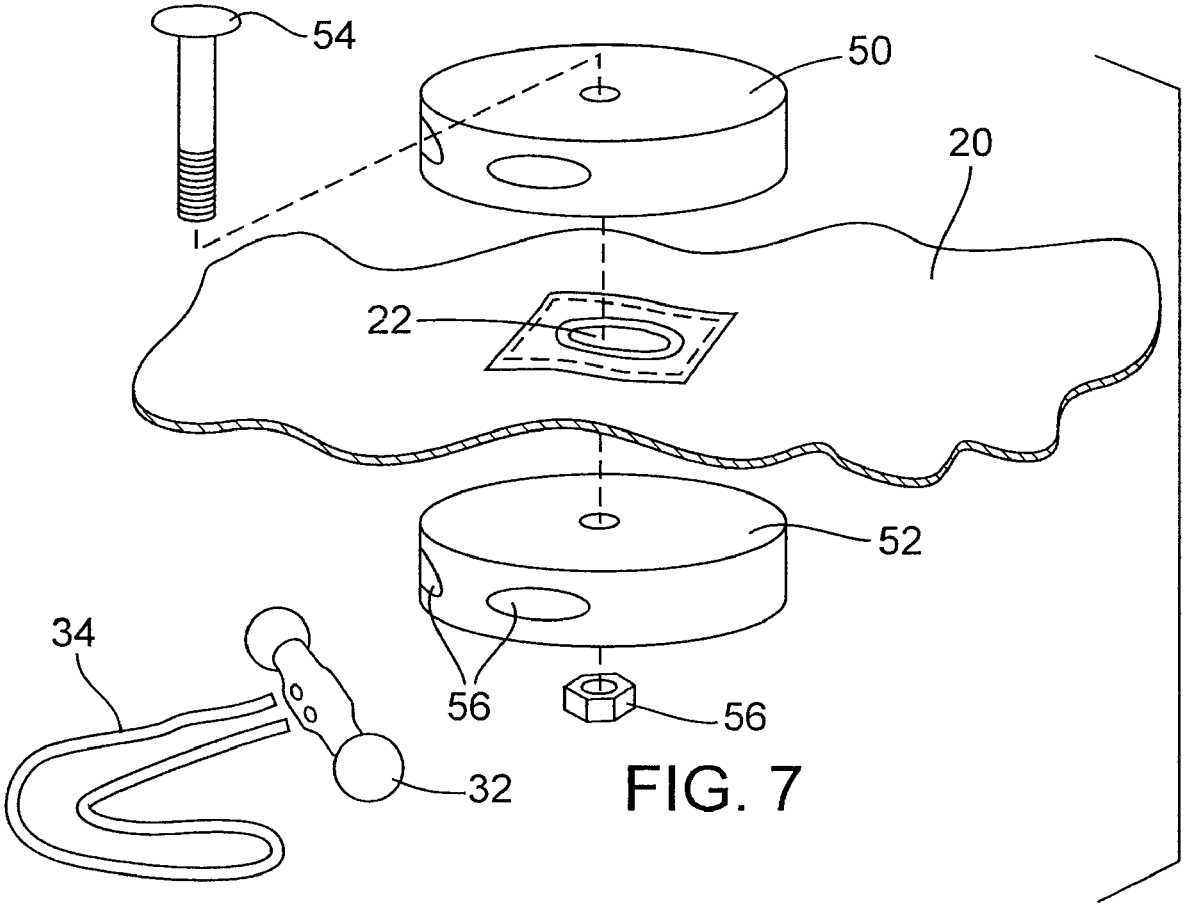
FIG. 7 is an exploded oblique view showing the individual components used in the attachment device assembly of FIG. 6.

The arrangement seen in FIG. 6 shows upper assembly part 50 and lower assembly part 52 that are attached to the safety pad 20 and fastened by a bold 54 passing through the trampoline safety pad hole 22 and secured at the other end by a nut 56. Cord 34 passes through a hole 56 in the lower assembly part 52 and is connected to the rigid connector piece 32. FIG. 7 shows the relationship between the components of this arrangement. The rigid connector piece 32 is then attached to the bouncing surface ring 30 as shown in FIG. 5.

Figure 8:
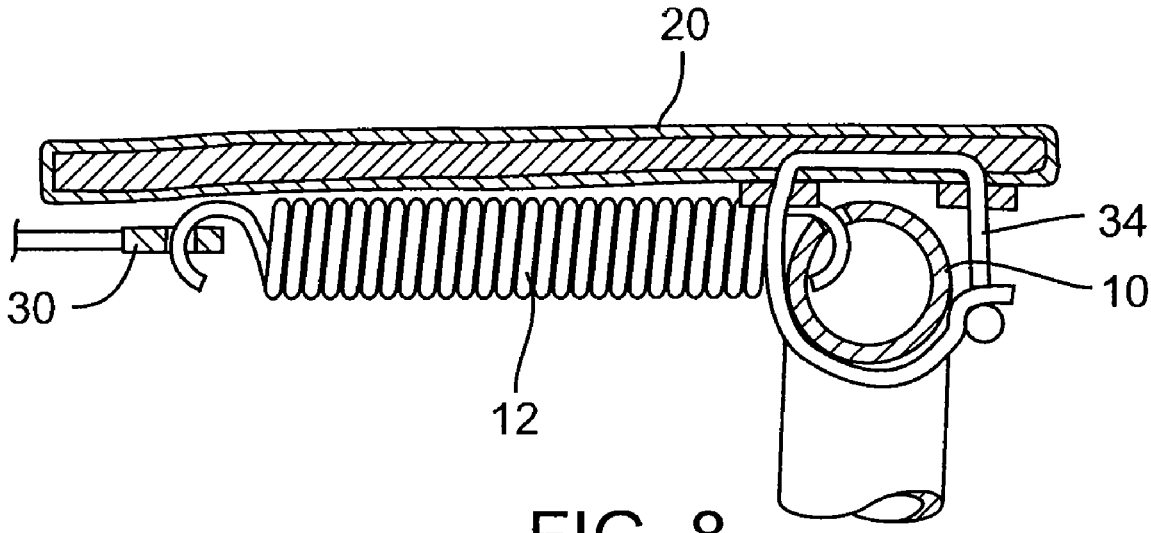
FIG. 8 is an enlarged vertical cross-sectional view of a third apparatus for attaching a pad to a trampoline frame.
Figure 9:
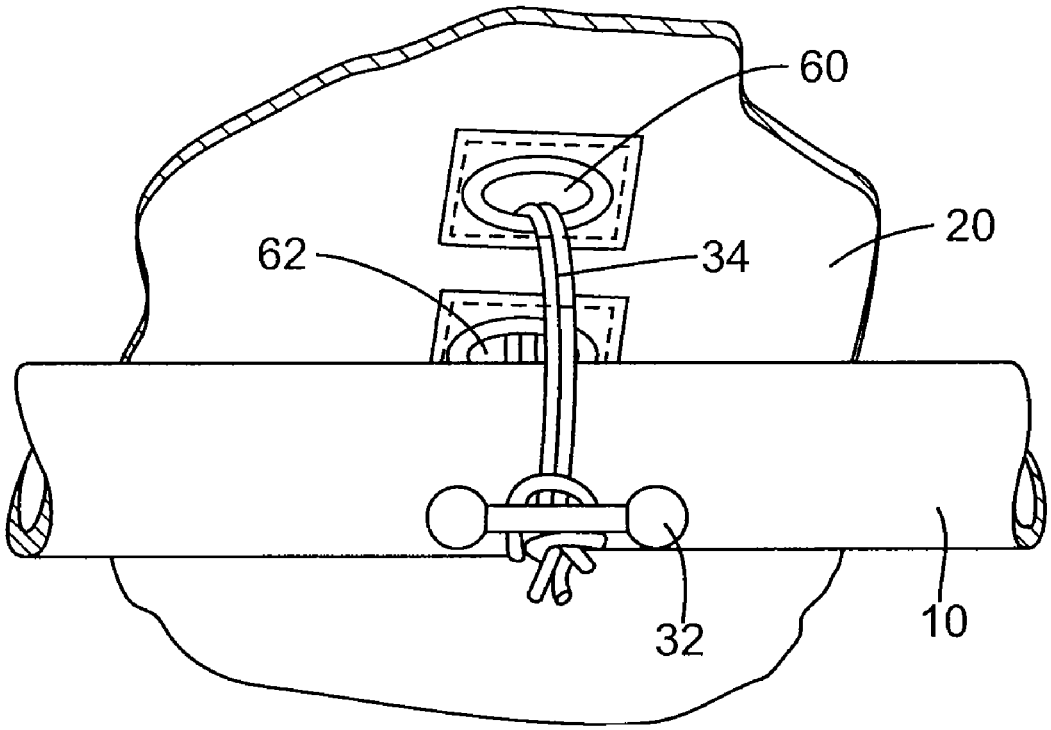
FIG. 9 is a bottom plan view showing the assembly used in the attachment device assembly of FIG. 8.

An additional arrangement is seen in FIG. 8. Cord 34 is attached to the rigid connector piece 32. It begins on one side of trampoline frame 10, passes through hole 60 in the lower safety pad cover and exits hole 62 in the lower safety pad cover. It then passes back around trampoline frame 10 and is looped over the rigid connector piece 32. FIG. 9 shows the relationship between the components of this arrangement.

Through use of the rigid connector to the bed of the trampoline, the connection between the pad and the bouncing surface is easily and quickly removable without the use of tools. The use of the elastic type cord keeps the pad centered over the springs to provide the required protection, but absorbs the shock and energy of impact. This serves to prevent damage to the pads caused when the user bounces onto the pads. One consideration is the length of elastic cord connecting the safety pad to the bouncing surface ring. It is advantageous to allow a slack length of elastic cord such that the pad must be displaced prior to the cord being engaged. This serves to prolong the life of the cords by reducing the forces and strain during normal use.

It should be understood that many changes and modifications can be made to the arrangements described above. For example, although some of the methods and apparatus described herein relate to attaching a pad to a trampoline, such methods and apparatus are useful for other devices in which one must attach a pad to a frame. It is therefore intended that the foregoing detailed description be understood as an illustration of embodiments, and not as a definition of the invention. It is only the following claims, including all equivalents that are intended to define the scope of this invention.

The invention claimed is:

1. A trampoline enclosure system comprising:

a trampoline having a frame, a rebounding surface supported by the frame, and a plurality of legs which support the frame at an elevation above ground level;

a plurality of poles supported by the legs, each pole having an upper end portion and a wall support portion located above the level of the surface;

a flexible top line which extends between the upper end portions of adjacent poles;

a generally cylindrical wall made of a flexible netting material which is secured to the wall support portions of the poles and to the top line so that the wall defines a chamber above the rebounding surface; and a protective cap at the top of the upper end portion of each pole, the cap supporting the flexible top line at such an elevation that the top surface of the protective cap is even or nearly even with the upper edge of the wall, the protective cap having a shock absorbing element positioned so that the cap descends for a short distance when downward pressure is applied to the protective cap.

2. A trampoline enclosure system comprising:

a trampoline having a frame, a rebounding surface supported by the frame, and a plurality of vertically-extending legs which support the frame at an elevation above ground level;

a plurality of poles supported by the legs, each pole having an upper end portion and a wall support portion located above the level of the surface;

a flexible top line which extends between the upper end portions of adjacent poles;

a generally cylindrical wall made of a flexible netting material which is secured to the wall support portions of the poles and to the top line so that the wall defines a chamber above the rebounding surface; and a protective cap at the top of the upper end portion of each pole, the cap defining an upwardly opening slot that receives the flexible top line and supports the flexible top line at such an elevation that the top surface of the protective cap is even or nearly even with the upper edge of the wall.

3. A trampoline enclosure system comprising:

a trampoline having a frame, a rebounding surface supported by the frame, and a plurality of vertically-extending legs which support the frame at an elevation above ground level;

a plurality of poles supported by the legs, each pole having an upper end portion and a wall support portion located above the level of the surface;

a flexible top line which extends between the upper end portions of adjacent poles;

a generally cylindrical wall made of a flexible netting material which is secured to the wall support portions of the poles and to the top line so that the wall defines a chamber above the rebounding surface; and a protective cap at the top of the upper end portion of each pest pole, the cap defining an upwardly opening slot that receives the flexible top line such that the cap supports the flexible top line in the slot.

* * * * *